US010515622B2

(12) United States Patent
Tani

(10) Patent No.: US 10,515,622 B2
(45) Date of Patent: Dec. 24, 2019

(54) ACTIVE NOISE REDUCING DEVICE, MOBILE DEVICE, AND ACTIVE NOISE REDUCING METHOD

(71) Applicant: Panasonic Intellectual Property Management Co., Ltd., Osaka (JP)

(72) Inventor: Mitsuhiro Tani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/326,382

(22) PCT Filed: Sep. 5, 2017

(86) PCT No.: PCT/JP2017/031866

§ 371 (c)(1),
(2) Date: Feb. 19, 2019

(87) PCT Pub. No.: WO2018/047790

PCT Pub. Date: Mar. 15, 2018

(65) Prior Publication Data

US 2019/0206382 A1 Jul. 4, 2019

(30) Foreign Application Priority Data

Sep. 12, 2016 (JP) ..... 2016-178051

(51) Int. Cl.
*G10K 11/178* (2006.01)

(52) U.S. Cl.
CPC .. *G10K 11/17853* (2018.01); *G10K 11/17823* (2018.01); *G10K 11/17825* (2018.01); *G10K 11/17879* (2018.01); *G10K 2210/3028* (2013.01); *G10K 2210/3044* (2013.01)

(58) Field of Classification Search
CPC ..... G10K 11/17853; G10K 2210/3044; G10K 2210/3028; G10K 11/17823; G10K 11/17879; G10K 11/17825
USPC ..... 381/71.4
See application file for complete search history.

(56) References Cited

U.S. PATENT DOCUMENTS 9,596,540 B2 * 3/2017 Tani ..... G10K 11/178
2015/0063581 A1 3/2015 Tani et al.

FOREIGN PATENT DOCUMENTS

| | | |
|---|---|---|
| JP | 6-059688 | 3/1994 |
| JP | 7-028474 | 1/1995 |
| JP | 2010-070023 | 4/2010 |
| WO | 2014/006846 | 1/2014 |

OTHER PUBLICATIONS

International Search Report of PCT application No. PCT/JP2017/031866 dated Nov. 7, 2017.

* cited by examiner

*Primary Examiner* — Paul Kim
(74) *Attorney, Agent, or Firm* — Greenblum & Bernstein, P.L.C.

(57) ABSTRACT

A combined reference signal generation unit included in an active noise reducing device has a plurality of filters that is applied on a one-on-one basis to the plurality of input reference signals and an adder that adds up the plurality of reference signals to which the plurality of filters is applied on a one-on-one basis to generate a combined reference signal.

9 Claims, 8 Drawing Sheets

ACTIVE NOISE REDUCING DEVICE, MOBILE DEVICE, AND ACTIVE NOISE REDUCING METHOD

CROSS-REFERENCE TO RELATED APPLICATIONS

This application is a U.S. national stage application of the PCT International Application No. PCT/JP2017/031866 filed on Sep. 5, 2017, which claims the benefit of foreign priority of Japanese patent application No. 2016-178051 filed on Sep. 12, 2016, the contents all of which are incorporated herein by reference.

TECHNICAL FIELD

The present invention relates to an active noise reducing device that actively reduces noise by causing a cancel sound to interfere with the noise, a mobile device using the active noise reducing device, and an active noise reducing method.

BACKGROUND ART

There has been conventionally known an active noise reducing device that actively reduces noise by outputting a cancel sound for cancelling out the noise from a cancel sound source through the use of a reference signal correlating with the noise and an error signal based on a residual sound in which the noise and the cancel sound interfere with each other in a predetermined space (for example, refer to PTL 1). The active noise reducing device generates a cancel signal to output the cancel sound using an adaptive filter such that a sum of square of the error signal becomes minimum.

CITATION LIST

Patent Literature

PTL 1: WO 2014/006846

SUMMARY OF THE INVENTION

The present invention provides an active noise reducing device that uses a plurality of reference signals and enables decrease in a number of adaptive filters.

The active noise reducing device according to an aspect of the present invention is an active noise reducing device that reduces noise in a predetermined space and includes a plurality of reference signal input units, a combined reference signal generation unit, an adaptive filter unit, a cancel signal output unit, a cancel sound source, an error signal input unit, a simulated acoustic transmission characteristic filter unit, and a filter coefficient update unit. The plurality of reference signal input units accepts inputs of reference signals correlating with the noise. The combined reference signal generation unit uses the plurality of input reference signals to generate a combined reference signal. The adaptive filter unit applies an adaptive filter to the generated combined reference signal to generate a cancel signal. The cancel signal output unit outputs the generated cancel signal. The cancel sound source generates a cancel sound corresponding to the cancel signal. The error signal input unit inputs an error signal corresponding to a residual sound resulting from interference with the noise. The simulated acoustic transmission characteristic filter unit generates a filtered combined reference signal by correcting the combined reference signal with a simulated transmission characteristic in which an acoustic transmission characteristic of the cancel signal output unit to the error signal input unit is simulated. The filter coefficient update unit uses the error signal and the generated filtered combined reference signal to update a coefficient of the adaptive filter in succession. The combined reference signal generation unit has a plurality of filters that is applied to the plurality of input reference signals and an adder that adds up the plurality of reference signals to which the plurality of filters is applied to generate the combined reference signal.

According to the present invention, it is possible to implement an active noise reducing device that enables decrease in the number of adaptive filters while using a plurality of reference signals. Therefore, the number of sensors can be increased in one and the same circuit configuration to improve performance.

DESCRIPTION OF EMBODIMENT

Figure 1:
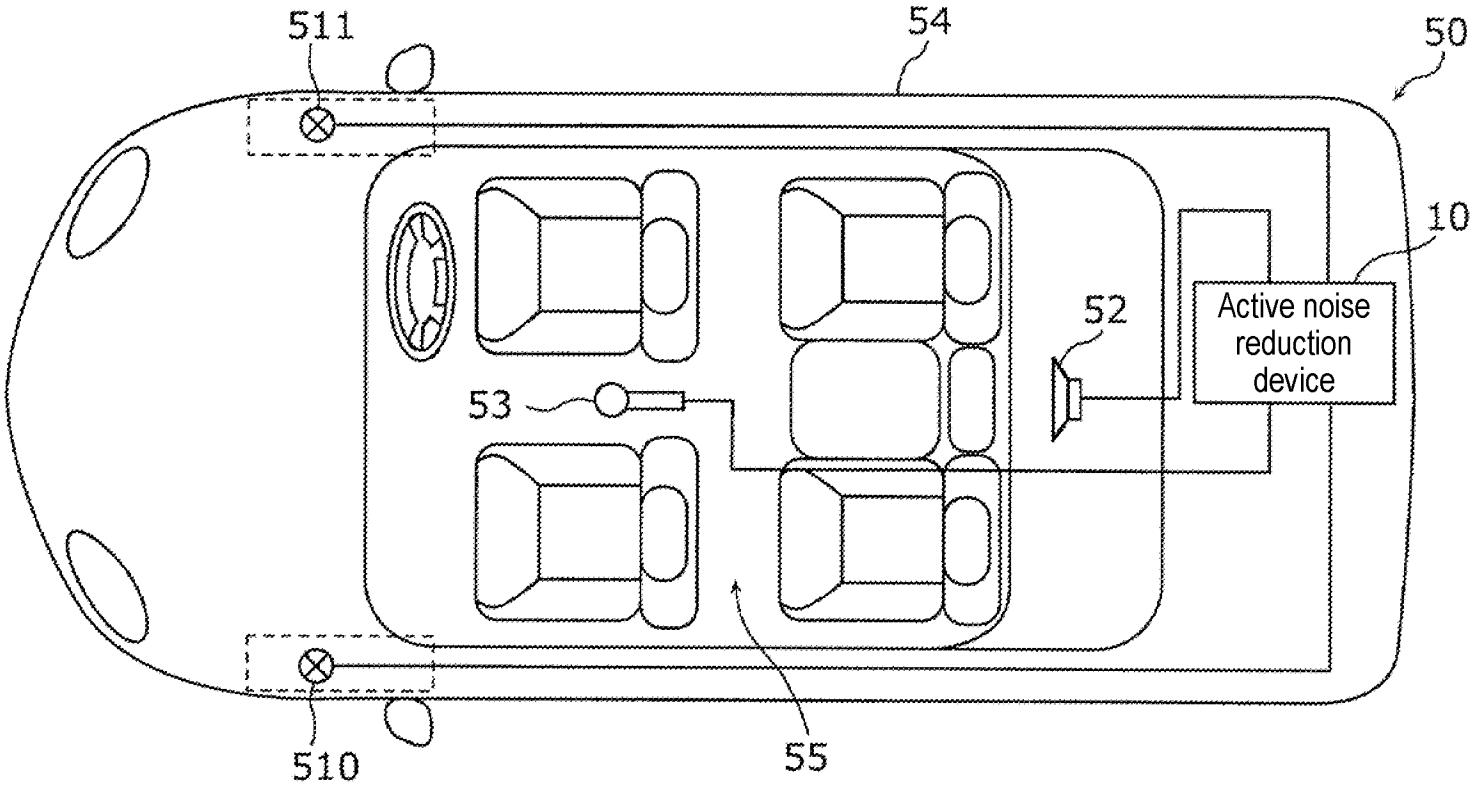
FIG. 1 is a schematic view of a vehicle that includes an active noise reducing device according to an exemplary embodiment.

Prior to description of exemplary embodiments of the present invention, a problem with a conventional device will be briefly described. To apply an active noise reducing device to noise in a vehicle interior, for example, sensors are installed at a plurality of places so that multiple coherence is enhanced by a plurality of reference signals. In this configuration, one adaptive filter is necessary for one reference signal, which causes a problem of increase in a number of adaptive filters with a growth in amount of arithmetic operations.

The active noise reducing device according to an aspect of the present invention is an active noise reducing device that reduces noise in a predetermined space and includes a plurality of reference signal input units, a combined reference signal generation unit, an adaptive filter unit, a cancel signal output unit, a cancel sound source, an error signal input unit, a simulated acoustic transmission characteristic filter unit, and a filter coefficient update unit. The plurality of reference signal input units inputs reference signals correlating with the noise. The combined reference signal generation unit uses the plurality of input reference signals to generate a combined reference signal. The adaptive filter unit applies an adaptive filter to the generated combined reference signal to generate a cancel signal. The cancel signal output unit outputs the generated cancel signal. The cancel sound source generates a cancel sound corresponding to the cancel signal. The error signal input unit inputs an error signal corresponding to a residual sound resulting from interference with the noise. The simulated acoustic transmission characteristic filter unit generates a filtered combined reference signal by correcting the combined reference signal with a simulated transmission characteristic in which an acoustic transmission characteristic of the cancel signal output unit to the error signal input unit is simulated. The filter coefficient update unit uses the error signal and the generated filtered combined reference signal to update a coefficient of the adaptive filter in succession. The combined reference signal generation unit has a plurality of filters that is applied to the plurality of input reference signals and an adder that adds up the plurality of reference signals to which the plurality of filters is applied to generate the combined reference signal.

This active noise reducing device can decrease the number of adaptive filters while using a plurality of reference signals. Decreasing the number of the adaptive filters reduces the amount of arithmetic operations.

In addition, at least one of the plurality of filters is a bandpass filter, for example.

Accordingly, the active noise reducing device can attenuate unnecessary bands of the plurality of reference signals by the at least one bandpass filter.

In addition, one of the plurality of filters is a low-pass filter, for example.

Accordingly, the active noise reducing device can attenuate the unnecessary bands of the plurality of reference signals by the low-pass filter.

For example, the plurality of filters characteristically has passbands not overlapping with each other.

Since the passbands of the plurality of filters do not overlap with each other, it is possible to reduce influence of one reference signal on the band of the other reference signal as a target of noise reduction.

For example, the error signal is input from an error signal source disposed in the predetermined space into the error signal input unit, and each of the reference signals is input from a reference signal source disposed outside the predetermined space.

This active noise reducing device can reduce noise by a reference signal acquired from a device disposed outside the predetermined space.

For example, the reference signal source is an acceleration sensor or a microphone.

This active noise reducing device can reduce noise with the acceleration sensor or the microphone as a reference signal source.

A mobile device according to an aspect of the present invention includes a reference signal source that outputs the plurality of reference signals and an error signal source that outputs the error signal to the error signal input unit.

This mobile device can reduce the number of adaptive filters while using a plurality of reference signals. Decreasing the number of the adaptive filters reduces the amount of arithmetic operations.

For example, the mobile device is a vehicle, the predetermined space is a space of a vehicle interior, and the noise is road noise.

This mobile device can reduce the road noise heard in the space of the vehicle interior.

In addition, for example, the reference signal source includes an acceleration sensor and a microphone, and a filter with a passband of frequencies having mainly structure borne noise is applied to the reference signal output by the acceleration sensor. A filter with a passband of frequencies having mainly air borne noise is applied to the reference signal output by the microphone.

This mobile device can reduce the structure borne noise and the air borne noise different from the structure borne noise in a generation mechanism, by the use of one each adaptive filter.

An active noise reducing method according to an aspect of the present invention is an active noise reducing method that reduces noise in a predetermined space. A plurality of reference signals correlating with the noise is used to generate a combined reference signal. An adaptive filter is applied to the generated combined reference signal to generate a cancel signal. A filtered combined reference signal is generated by correcting the combined reference signal with a simulated transmission characteristic in which an acoustic transmission characteristic of a cancel signal output unit that outputs a cancel sound generated by a cancel sound source corresponding to the cancel signal to an error signal input unit that accepts input of an error signal corresponding to a residual sound resulting from interference between the cancel sound and the noise. The error signal and the generated filtered combined reference signal are used to update a coefficient of the adaptive filter in succession. At generation of the combined reference signal, a filter is applied to the plurality of reference signals, and the plurality of reference signals to which the filter is applied is added up to generate the combined reference signal.

According to this active noise reducing method, it is possible to reduce the number of adaptive filters while using a plurality of reference signals. Decreasing the number of the adaptive filters reduces the amount of arithmetic operations.

Exemplary embodiments will be specifically described below with reference to the drawings. The exemplary embodiments described below are all comprehensive or specific examples. Numerical values, shapes, materials, constituents, and arrangement positions and connection forms of the constituents described below in relation to the following exemplary embodiments are mere examples and are not intended to limit the present invention. Among the constituents in the exemplary embodiments described below, constituents which are not described in the independent claims showing the top level concept are described as arbitrary constituents.

The drawings are schematic drawings and are not necessarily prepared in a strict manner. In the drawings, substantially identical constituents are given identical reference signs, and duplicated descriptions of the constituents will be omitted or simplified in some cases.

(First Exemplary Embodiment)

[Overall Configuration of a Vehicle Including an Active Noise Reducing Device]

In relation to the first exemplary embodiment, an active noise reducing device installed in a vehicle will be described as an example. FIG. 1 is a schematic view of a vehicle including the active noise reducing device according to the first exemplary embodiment.

Vehicle 50 is an example of a mobile device that includes active noise reducing device 10 according to the first exemplary embodiment, two reference signal sources 510 and 511, cancel sound source 52, error signal source 53, and vehicle main body 54. Vehicle 50 is specifically an automobile but is particularly not limited to this.

Reference signal sources 510 and 511 are transducers that output reference signals respectively correlating with a first component and a second component included in noise N0 in predetermined space 55. In the first exemplary embodiment, reference signal sources 510 and 511 are acceleration sensors that are disposed outside predetermined space 55. Specifically, reference signal source 510 is attached to a sub-frame, and reference signal source 511 is attached to an upper part of a suspension. FIG. 1 illustrates reference signal sources 510 and 511 as separate acceleration sensors disposed at different positions. Alternatively, two or more outputs from one multi-axial sensor may be used as reference signals.

In the first exemplary embodiment, a number of the reference signal sources is two. Alternatively, the number of the reference signal sources may be three or more. That is, vehicle 50 includes one or more reference signal sources that output a plurality of reference signals. The reference signal sources are desirably installed outside predetermined space 55 because the reference signals need to be acquired as earlier than noise as possible to meet causal laws. However, this does not impede installation of the reference signal sources in the predetermined space.

Figure 2:
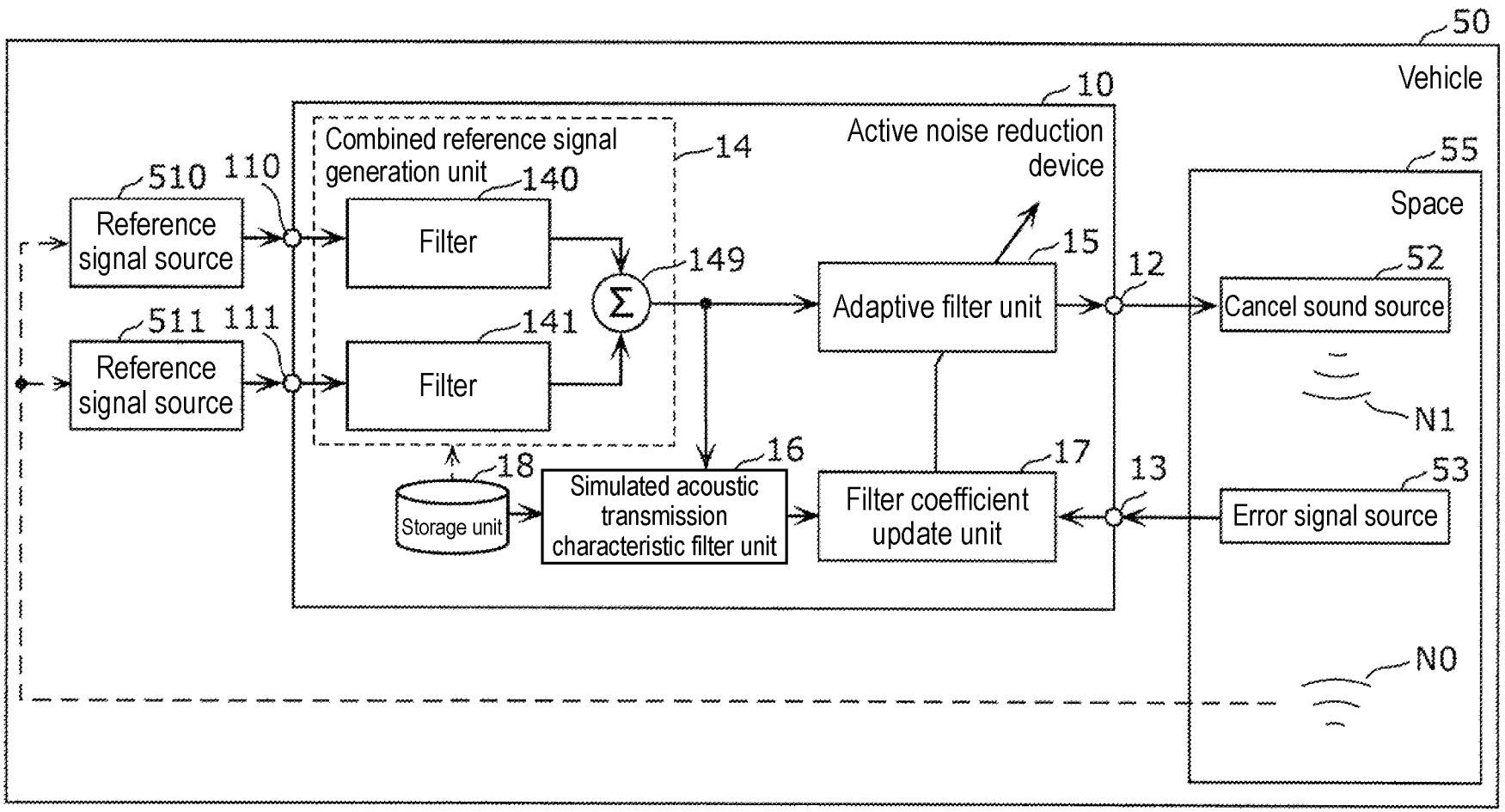
FIG. 2 is a functional block diagram of the active noise reducing device according to the exemplary embodiment.

Noise N0 is road noise, for example, as illustrated in FIG. 2. A transmission route of the road noise is complicated and thus acceleration sensors are effectively disposed at a plurality of positions.

Cancel sound source 52 uses cancel signal y to output cancel sound N1 to the predetermined space. In the first exemplary embodiment, cancel sound source 52 is a speaker. Alternatively, a partial structure of vehicle 50 (for example, sun roof) may be vibrated by a drive mechanism such as an actuator to output cancel sound N1. In active noise reducing device 10, a plurality of cancel sound sources 52 may be used and there is no particular limitation on positions of cancel sound sources 52.

Error signal source 53 detects a residual sound in which noise N0 and cancel sound N1 interfere with each other in predetermined space 55, and outputs error signal e based on the residual sound. Error signal source 53 is a transducer such as a microphone and is desirably installed in a headliner or the like in predetermined space 55. Vehicle 50 may include a plurality of error signal sources 53.

Vehicle main body 54 is a structure formed from a chassis and a body of vehicle 50. Vehicle main body 54 forms predetermined space 55 (the space in the vehicle interior) where cancel sound source 52 and error signal source 53 are disposed.

[Configuration and Operations of the Active Noise Reducing Device]

Figure 3:
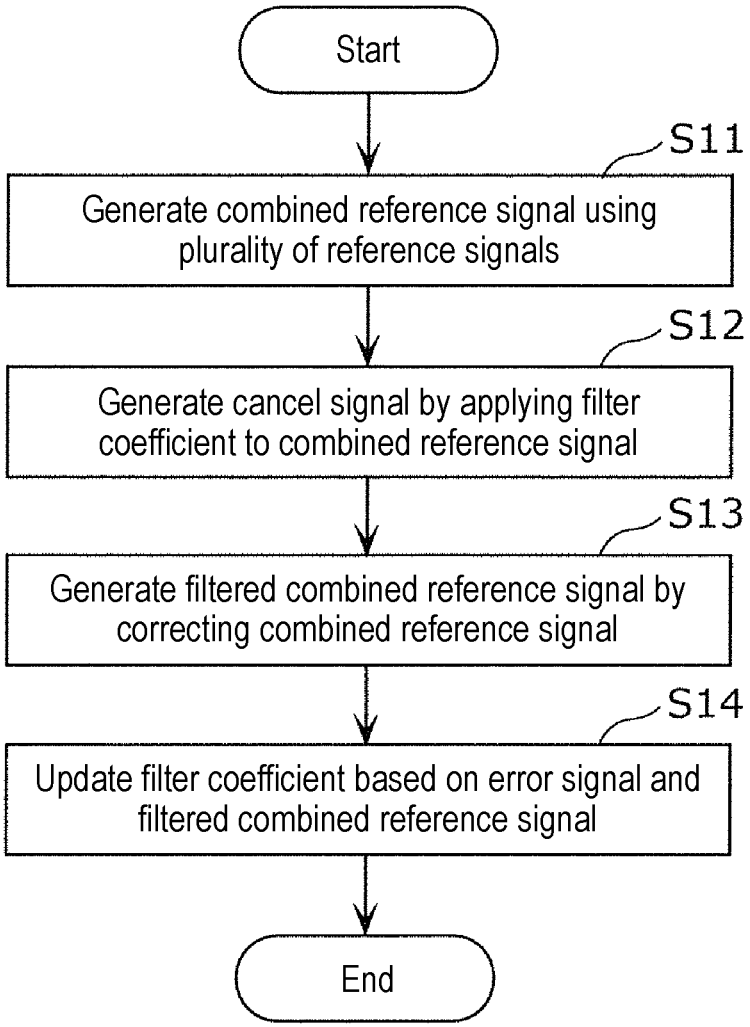
FIG. 3 is a flowchart of operations by the active noise reducing device according to the exemplary embodiment.

Next, a configuration and operations of active noise reducing device 10 will be described. FIG. 2 is a functional block diagram of active noise reducing device 10. FIG. 3 is a flowchart of operations of active noise reducing device 10.

As illustrated in FIG. 2, active noise reducing device 10 includes reference signal input terminals 110 and 111, cancel signal output terminal 12, error signal input terminal 13, combined reference signal generation unit 14, adaptive filter unit 15, simulated acoustic transmission characteristic filter unit 16, and filter coefficient update unit 17. Each of adaptive filter unit 15, simulated acoustic transmission characteristic filter unit 16, and filter coefficient update unit 17 is implemented by a processor such as a digital signal processor (DSP), for example. Alternatively, each of these components may be implemented by a microcomputer or a dedicated circuit and a combinations of them. Hereinafter, related constituents will be described in detail for each of steps described in the flowchart of FIG. 3.

[Generation of a Combined Reference Signal]

First, combined reference signal generation unit 14 uses a plurality of input reference signals to generate a combined reference signal (S11 in FIG. 3). Specifically, combined reference signal generation unit 14 uses reference signal x0 input into reference signal input 110 and reference signal x1 input into reference signal input terminal 111 to generate combined reference signal xcomb.

Reference signal input terminal 110 is an example of a reference signal input unit that is formed from metal or the like. Reference signal input terminal 110 accepts input of reference signal x0 correlating with the first component included in noise N0 in predetermined space 55.

Reference signal input terminal 111 is an example of a reference signal input unit that is formed from metal or the like. Reference signal input terminal 111 accepts input of reference signal x1 correlating with the second component included in noise N0 in space 55.

Figure 4:
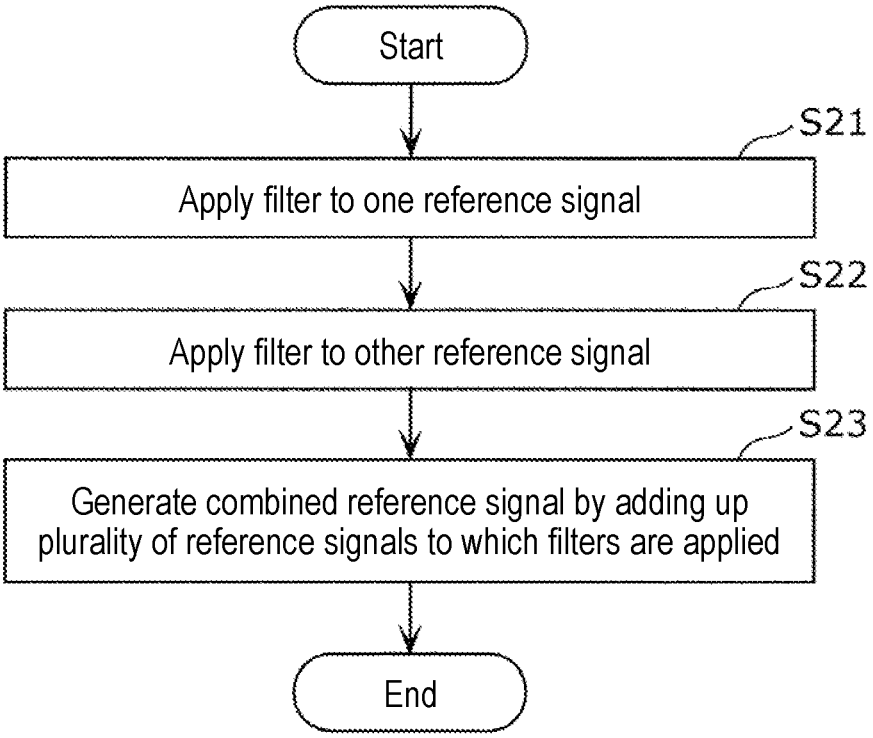
FIG. 4 is a flowchart of a method for generating a combined reference signal.
Figure 5:
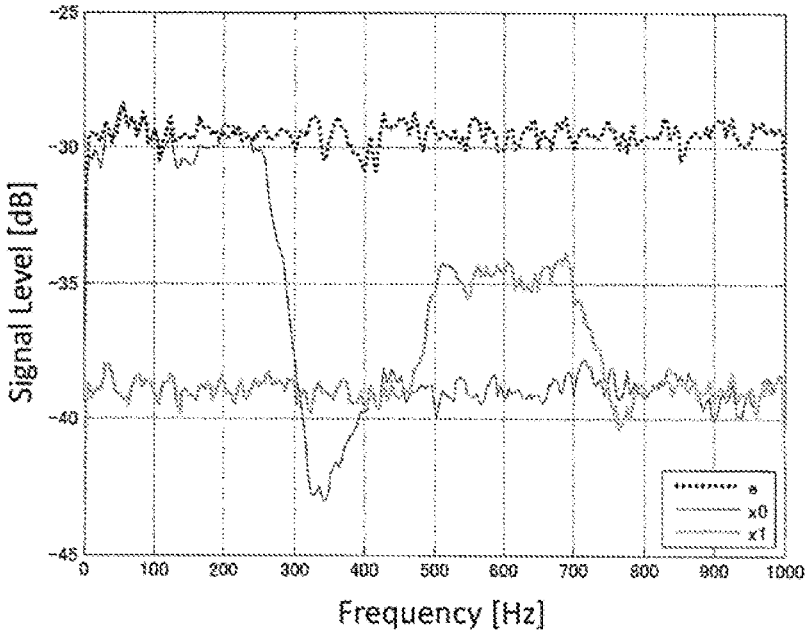
FIG. 5 is a diagram illustrating an example of spectrums of a reference signal and an error signal in a first exemplary embodiment.
Figure 6:
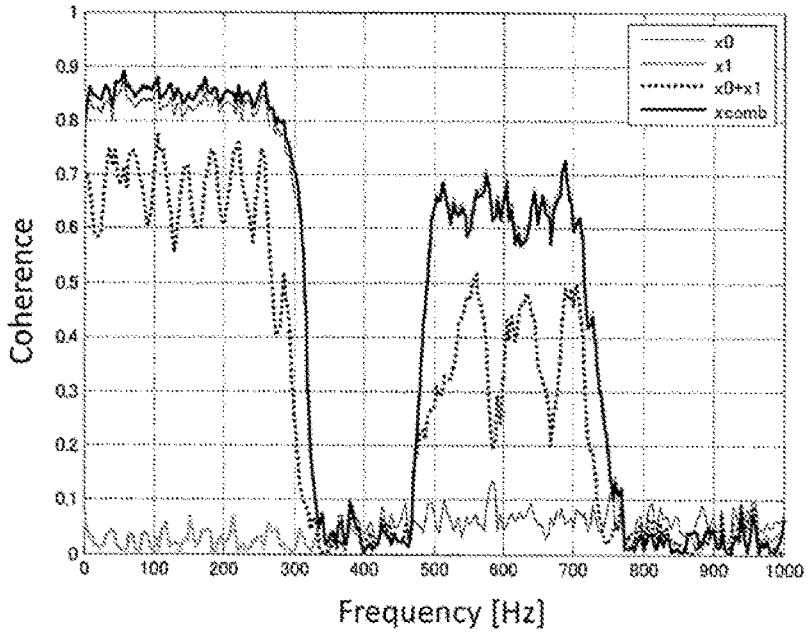
FIG. 6 is a diagram illustrating coherence of reference signals and a combined reference signal to the error signal illustrated in FIG. 5.
Figure 7:
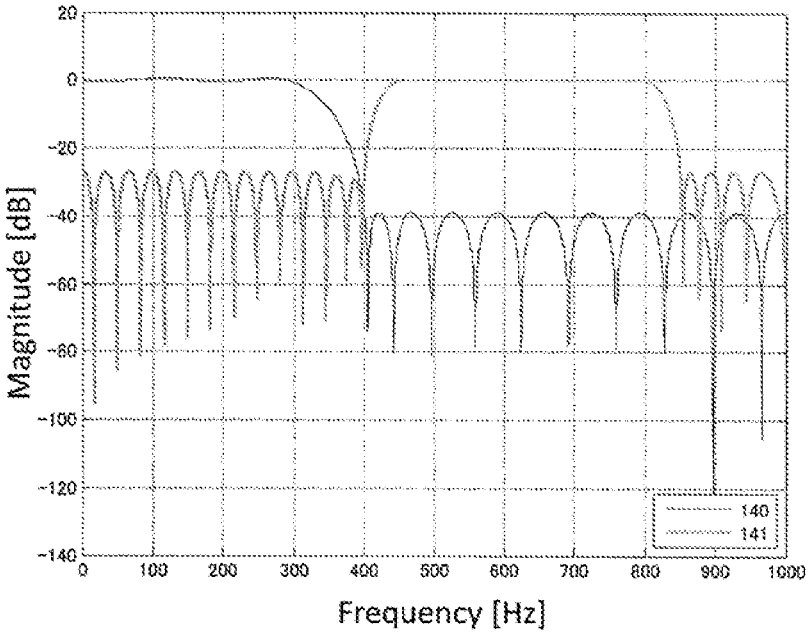
FIG. 7 is a diagram illustrating an example of filter characteristics of a plurality of filters.

Specifically, combined reference signal generation unit 14 has a plurality of filters (filter 140 and filter 141) and adder 149. Hereinafter, a method for generating a combined reference signal will be described with reference to FIG. 2 and FIGS. 4 to 7. FIG. 4 is a flowchart of the method for generating a combined reference signal. FIG. 5 is a diagram illustrating an example of spectrums of reference signals x0 and x1 and error signal e in the first exemplary embodiment. FIG. 6 is a diagram illustrating coherence of reference signals x0 and x1 and combined reference signal x0+x1, xcomb, to error signal e illustrated in FIG. 5. In a graph of FIG. 6, there is no overlap between a band of reference signal x0 with high coherence and a band of reference signal x1 with high coherence. That is, there is no overlap between the band correlating with the first component and the band correlating with the second component. FIG. 7 is a diagram illustrating an example of filter characteristics of the plurality of filters 140 and 141.

Combined reference signal generation unit 14 first applies filter 140 to reference signal x0 (S21). Filter 140 is a filter that has a first passband to be applied to input reference signal x0.

In the first exemplary embodiment, reference signal x0 has high coherence in a band of a predetermined frequency (for example, 280 Hz) and less, and thus this band is set as a target of noise reduction. Therefore, filter 140 is a low-pass filter (LPF) at a cutoff frequency of 320 Hz. That is, one of the plurality of filters 140, 141 is a low-pass filer. In this case, the first passband is a band of 320 Hz and less. The first passband is set to a band where the user wishes to reduce noise by active noise reducing device 10 (a band as a target of noise reduction). That is, the first passband is determined as appropriate according to reference signal x0.

Next, combined reference signal generation unit 14 applies filter 141 to reference signal x1 (S22). Filter 141 is a filter that has a second passband to be applied to input reference signal x1.

In the first exemplary embodiment, reference signal x1 has high coherence in a band of predetermined frequencies (for example, 500 Hz to 700 Hz inclusive), and thus this band is set as a target of noise reduction. That is, reference signals x0 and x1 are different in the band as a target of noise reduction. Therefore, filter 141 is a bandpass filter (BPF) in which a lower limit value of cutoff frequency is 430 Hz and an upper limit value of cutoff frequency is 820 Hz. That is, at least one of the plurality of filters 140, 141 is a bandpass filter, for example.

The second passband is different from the first passband. In other words, the plurality of filters 140, 141 is different in the passband. The second passband is set to a band where the user wishes to reduce noise by active noise reducing device 10 (a band as a target of noise reduction). That is, the second passband is determined as appropriate according to reference signal x1.

In the first exemplary embodiment, as described above, the upper limit frequency in the first passband is less than or equal to the lower limit frequency in the second passband. That is, the plurality of filters 140, 141 characteristically has passbands not overlapping with each other.

Adder 149 adds up the plurality of reference signals to which the filters are applied to generate combined reference signal xcomb (S23). In other words, adder 149 adds up the plurality of reference signals to which one of the plurality of filters 140, 141 is applied to generate combined reference signal xcomb.

Adder 149 specifically adds up reference signal x0 to which filter 140 is applied and reference signal x1 to which filter 141 is applied to generate combined reference signal xcomb (S23). The generated combined reference signal is output to adaptive filter unit 15 and simulated acoustic transmission characteristic filter unit 16.

Combined reference signal generation unit 14 described above is implemented by an analog circuit, for example. That is, each of filter 140 and filter 141 is an analog filter circuit, and adder 149 is implemented by an adder circuit using an operational amplifier or the like. Combined reference signal generation unit 14 may be implemented by a processor such as a digital signal processor (DSP) or a central processing unit (CPU) or the like. In this case, combined reference signal generation unit 14 operates based on a control program (software) stored in storage unit 18, for example. The control program may be stored in a storage unit different from storage unit 18 (for example, a storage unit built in combined reference signal generation unit 14).

[Generation of a Cancel Signal]

Adaptive filter unit 15 applies an adaptive filter to combined reference signal xcomb generated by combined reference signal generation unit 14 (multiplication) to generate cancel signal y (S12 of FIG. 3). Cancel signal y is used to output cancel sound N1 for reduction of noise N0 and is output to cancel signal output terminal 12. Adaptive filter unit 15 is implemented by an FIR filter or an IIR filter. Adaptive filter unit 15 outputs generated cancel signal y to cancel signal output terminal 12.

Cancel signal output terminal 12 is an example of a cancel signal output unit, which is a terminal formed from metal or the like. Cancel signal y generated by adaptive filter unit 15 is output to cancel signal output terminal 12. Cancel sound source 52 is connected to cancel signal output terminal 12. Accordingly, cancel signal y is output to cancel sound source 52 via cancel signal output terminal 12. Cancel sound source 52 outputs cancel sound N1 based on cancel signal y.

[Correction of a Combined Reference Signal]

Simulated acoustic transmission characteristic filter unit 16 generates filtered combined reference signal rcomb by correcting combined reference signal xcomb with simulated transmission characteristic Chat in which an acoustic transmission characteristic from cancel signal output terminal 12 to error signal input terminal 13 is simulated (S13 of FIG. 3). Simulated transmission characteristic Chat is actually measured in advance in space 55 and stored in storage unit 18, for example. Simulated transmission characteristic Chat may be determined by an algorithm using no predetermined value.

Storage unit 18 is a storage device that stores simulated transmission characteristic Chat. Storage unit 18 also stores coefficient W of an adaptive filter described later and others. Storage unit 18 is specifically implemented by a semiconductor memory or the like. When active noise reducing device 10 is implemented by a processor such as a DSP, storage unit 18 also stores control programs to be executed by the processor. Storage unit 18 may store other parameters to be used in signal processing by the active noise reducing device 10.

[Updating of a Coefficient of an Adaptive Filter]

Filter coefficient update unit 17 updates coefficient W of an adaptive filter in succession based on error signal e and generated filtered combined reference signal rcomb (S14 of FIG. 3). Error signal e is input from error signal input terminal 13.

Error signal input terminal 13 is an example of an error signal input unit that is formed from metal or the like. Error signal input terminal 13 accepts input of error signal e corresponding to a residual sound resulting from interference between cancel sound N1 generated from cancel sound source 52 corresponding to cancel signal y and noise N0. Error signal e is output by error signal source 53.

Filter coefficient update unit 17 specifically uses least mean square (LMS) method to calculate coefficient W of the adaptive filter such that a sum of square of error signal e becomes minimum, and outputs calculated coefficient W of the adaptive filter to adaptive filter unit 15. Filter coefficient update unit 17 updates coefficient W of the adaptive filter in succession. When a vector of filtered combined reference signal rcomb is expressed as R, coefficient W of the adaptive filter is expressed by the following (equation 1). In the equation, n is a natural number that represents an n-th sample in sampling period Ts. In the equation, μ represents scalar quantity that is a step size parameter to decide an update amount of coefficient W of the adaptive filter in one sampling.

$$W(n)=W(n-1)-\mu\cdot e(n)\cdot R(n) \quad \text{(Equation 1)}$$

Filter coefficient update unit 17 may update coefficient W of the adaptive filter by a method other than the LMS method.

[Advantageous Effects]

Advantageous effects obtained by the method for generating the combined reference signal will be described with reference to FIG. 6.

First, when the two reference signals are directly added up without using the active noise reducing device, coherence of the added signal with reference to error signal e is described as "x0+x1" in FIG. 6. In the added signal, coherence decreases in the bands where high coherence is ensured in single reference signals x0, x1.

As described above, directly adding up two reference signals results in decrease of coherence. Therefore, in general, one reference signal and the other reference signal are not added up but the plurality of reference signals is input into different adaptive filter units. Accordingly, one adaptive filter is necessary for one reference signal, which causes a problem of increase in the number of adaptive filter units with a growth in the amount of arithmetic operations.

In contrast to this, in active noise reducing device 10, filters for attenuating bands other than the band as a target of noise reduction are applied to the plurality of reference signals. The coherence of combined reference signal xcomb obtained by adding up reference signal x0 to which filter 140 is applied and reference signal x1 to which filter 141 is applied with reference to error signal e is indicated with "xcomb" in FIG. 6.

The coherence of combined reference signal xcomb with reference to error signal e is ensured to be equal to the high coherence obtained in the band of the single reference signal.

In this way, combined reference signal generation unit 14 can generate a combined reference signal with high coherence in a band where high coherence is obtained with a single reference signal. Accordingly, adaptive filter unit 15 can generate an appropriate cancel signal based on the combined reference signal. In active noise reducing device 10, only one adaptive filter unit 15 is used for a plurality of reference signals, which decreases the number of adaptive filters (adaptive filter units). That is, the amount of arithmetic operations can be reduced.

In the first exemplary embodiment, one reference signal and the other reference signal have bands as targets of noise reduction not overlapping with each other. The upper limit frequency (320 Hz) of the first passband is less than or equal to the lower limit frequency (430 Hz) of the second passband, and the first passband and the second passband do not overlap with each other.

That is, the plurality of filters included in combined reference signal generation unit 14 characteristically has passbands not overlapping with each other. In this case, the method for generating a combined reference signal by combined reference signal generation unit 14 is effective in particular.

However, even when the band as a target of noise reduction of one reference signal and the band as a target of noise reduction of the other reference signal overlap with each other, setting appropriately each of the first passb and and the second passb and makes it possible to generate an appropriate combined reference signal. Similarly, even when the first passband and the second passband overlap each other, an appropriate combined reference signal can be generated as far as the band as a target of noise reduction of one reference signal and the band as a target of noise reduction of the other reference signal can be separated from each other.

(Second Exemplary Embodiment)

Figure 8:
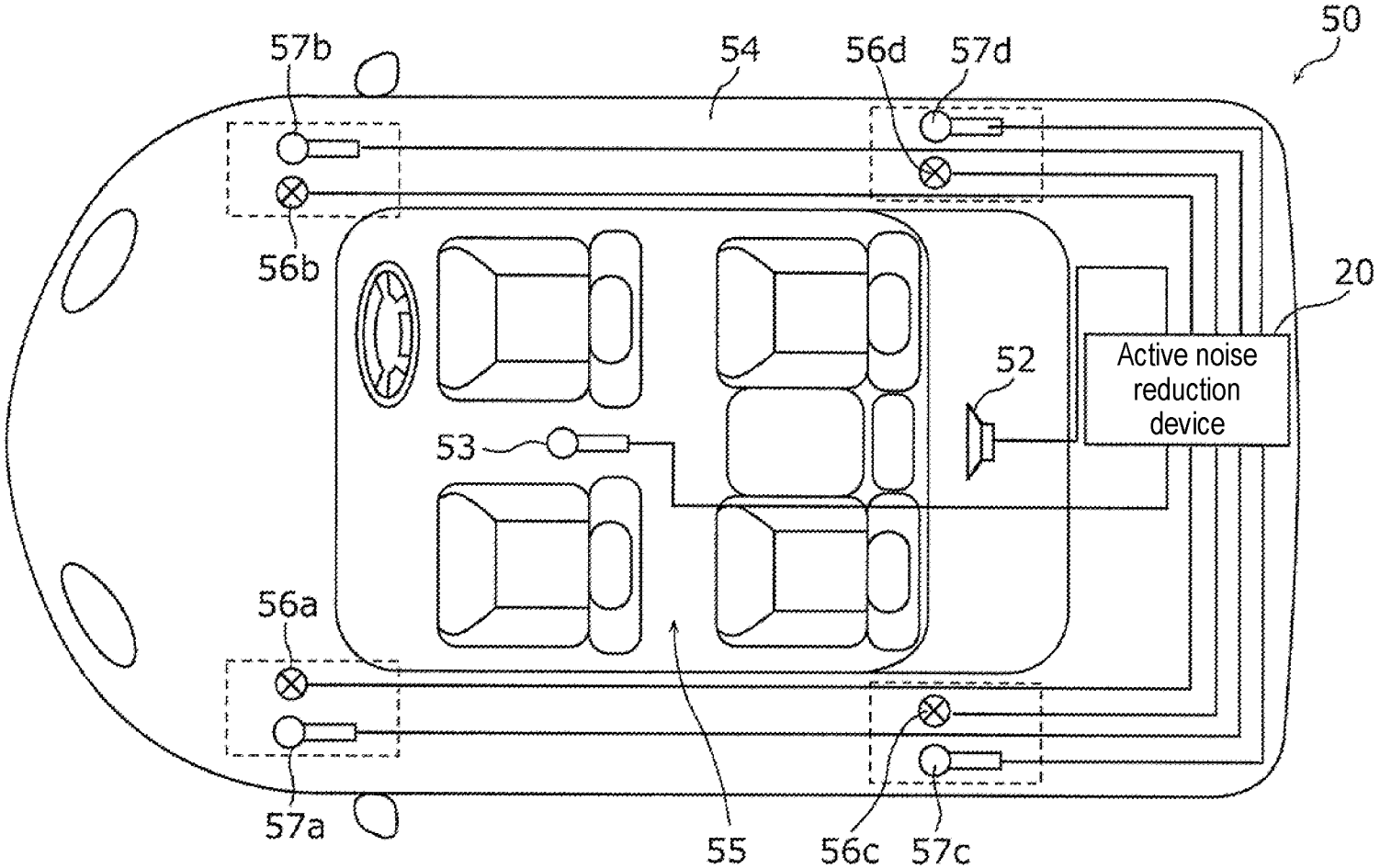
FIG. 8 is a schematic view of a vehicle that includes an active noise reducing device according to a second exemplary embodiment.

In the first exemplary embodiment, the plurality of reference signals is all output from the acceleration sensors as the reference signal sources. However, the plurality of reference signal sources may merely output signals correlating with the noise in space 55. For example, the plurality of reference signal sources may include a multi-axial acceleration sensor, a microphone, and others. In relation to the second exemplary embodiment, descriptions will be given as to an active noise reducing device using a biaxial acceleration sensor and a microphone as a plurality of reference signal sources and a vehicle including the active noise reducing device. FIG. 8 is a schematic view of the vehicle including the active noise reducing device according to the second exemplary embodiment. In relation to the second exemplary embodiment, differences from the first exemplary embodiment will be mainly described and descriptions of contents overlapping those of the first exemplary embodiment will be omitted.

As illustrated in FIG. 8, vehicle 50 is an example of a mobile device, which includes active noise reducing device 20 according to the second exemplary embodiment. Vehicle 50 also includes reference signal sources 56*a* to 56*d* and reference signal sources 57*a* to 57*d*. Vehicle 50 specifically is an automobile but is not limited to this.

Each of reference signal sources 56*a* to 56*d* is a transducer that outputs a reference signal correlating with noise N0 in predetermined space 55. Each of reference signal sources 56*a* to 56*d* is a biaxial acceleration sensor that outputs two reference signals corresponding to two axes.

Reference signal sources 56*a* to 56*d* are disposed outside predetermined space 55. Reference signal source 56*a* is attached to a sub-frame near a left front wheel, reference signal source 56*b* is attached to a sub-frame near a right front wheel, reference signal source 56*c* is attached to a sub-frame near a left rear wheel, and reference signal source 56*d* is attached to a sub-frame near a right rear wheel.

Each of reference signal sources 57*a* to 57*d* is a transducer that outputs a reference signal correlating with noise N0 in predetermined space 55. Each of reference signal sources 57*a* to 57*d* is a microphone that outputs one reference signal.

Reference signal sources 57*a* to 57*d* are disposed outside predetermined space 55. Reference signal source 57*a* is attached to a wheel well of the left front wheel, reference signal source 57*b* is attached to a wheel well of the right front wheel, reference signal source 57*c* is attached to a wheel well of the left rear wheel, and reference signal source 57*d* is attached to a wheel well of the right rear wheel.

Figure 9:
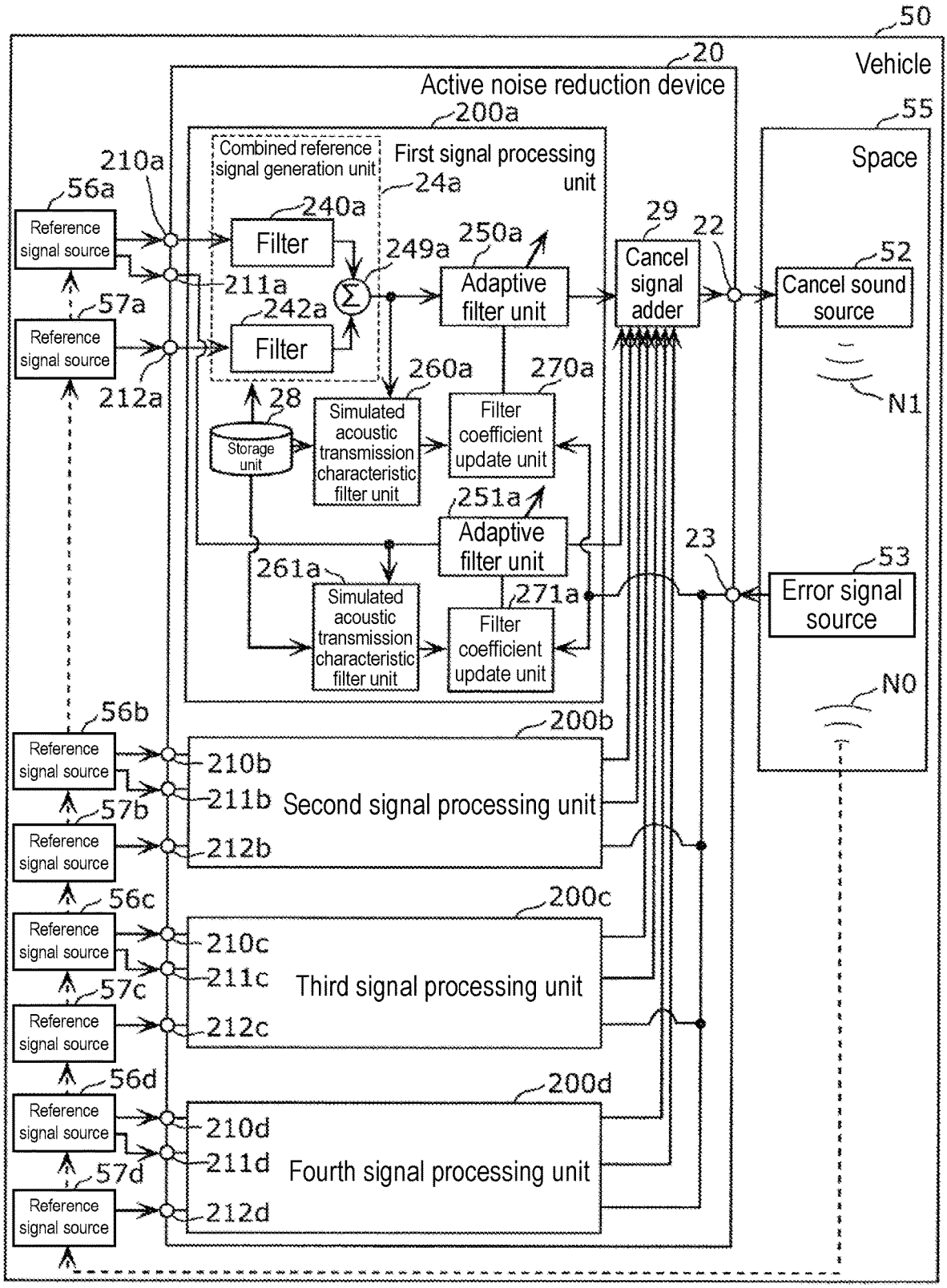
FIG. 9 is a functional block diagram of the active noise reducing device according to the second exemplary embodiment.

Next, a configuration of active noise reducing device 20 will be described. FIG. 9 is a functional block diagram of active noise reducing device 20.

As illustrated in FIG. 9, active noise reducing device 20 includes reference signal input terminals 210*a* to 212*a*, 210*b* to 212*b*, 210*c* to 212*c*, and 210*d* to 212*d*, cancel signal output terminal 22, and error signal input terminal 23. Active noise reduction device 20 also includes first signal processing unit 200*a*, second signal processing unit 200*b*, third signal processing unit 200*c*, fourth signal processing unit 200*d*, and cancel signal adder 29.

First signal processing unit 200*a* includes combined reference signal generation unit 24*a*, adaptive filter units 250*a*, 251*a*, simulated acoustic transmission characteristic filter units 260*a*, 261*a*, and filter coefficient update units 270*a*, 271*a*. Each of adaptive filter units 250*a*, 251*a*, simulated acoustic transmission characteristic filter units 260*a*, 261*a*, and filter coefficient update units 270*a*, 271*a* is implemented by a processor such as a digital signal processor (DSP), for example, but may be implemented by a microcomputer or a dedicated circuit.

Combined reference signal generation unit 24*a* included in first signal processing unit 200*a* is different from that in the first exemplary embodiment in setting as processing targets reference signal x0 input from reference signal source 56*a* into reference signal input terminal 210*a* and reference signal x2 output from reference signal source 57*a* to reference signal input terminal 212*a*. Specifically, filter 240*a* is applied to reference signal x0 input into reference signal input terminal 210*a* and filter 242*a* is applied to reference signal x2 input into reference signal input terminal 212*a*.

Reference signal source 56*a* mainly outputs a reference signal correlating with structure borne noise. Accordingly, filter 240*a* with a passband of frequencies having mainly structure borne noise is applied to reference signal output by reference signal source 56*a* (acceleration sensor). The frequencies having mainly structure borne noise are 20 to 600 Hz, for example.

On the other hand, reference signal source 57*a* (microphone) mainly outputs reference signal correlating with air borne noise. Accordingly, a filter with a passband of frequencies having mainly air borne noise is applied to the reference signal output by the microphone. The frequencies having mainly air borne noise are 400 to 10000 Hz, for example.

Adder 249*a* adds up reference signal to which filter 240*a* is applied and reference signal to which filter 242*a* is applied to generate combined reference signal.

Adaptive filter unit 250*a*, simulated acoustic transmission characteristic filter unit 260*a*, and filter coefficient update unit 270*a* perform the same processes as those in the first exemplary embodiment on the combined reference signal generated by combined reference signal generation unit 24*a*. Adaptive filter unit 250*a* outputs cancel signal to cancel signal adder 29.

On the other hand, reference signal input from reference signal source 56*a* into reference signal input terminal 211*a* is then input into adaptive filter unit 251*a*. Adaptive filter unit 251*a* applies an adaptive filter to reference signal x1 input into reference signal input terminal 211*a* to generate a cancel signal, and outputs the cancel signal to cancel signal adder 29. Simulated acoustic transmission characteristic filter unit 261*a* generates a filtered reference signal by correcting the reference signal with a simulated transmission characteristic in which an acoustic transmission characteristic of cancel signal output terminal 22 to error signal input terminal 23 is simulated. The simulated transmission characteristic is stored in storage unit 28, for example. Filter coefficient update unit 271*a* uses the error signal and the filtered reference signal generated by simulated acoustic transmission characteristic filter unit 261*a* to update a coefficient of the adaptive filter in succession.

As described above, first signal processing unit 200*a* outputs two cancel signals.

Second signal processing unit 200*b* outputs two cancel signals with two reference signals input from reference signal source 56*b* into reference signal input terminals 210*b*, 211*b* and a reference signal output from reference signal source 57*b* to reference signal input terminal 212*b* as processing targets. Signal processing performed by second signal processing unit 200*b* is the same as the signal processing performed by first signal processing unit 200*a* and thus descriptions of the signal processing will be omitted here.

Third signal processing unit 200*c* outputs two cancel signals with two reference signals input from reference signal source 56*c* into reference signal input terminals 210*c*, 211*c* and a reference signal output from reference signal source 57*c* to reference signal input terminal 212*c* as processing targets. Signal processing performed by third signal processing unit 200*c* is the same as the signal processing performed by first signal processing unit 200*a* and thus descriptions of the signal processing will be omitted here.

Fourth signal processing unit 200*d* outputs two cancel signals with two reference signals input from reference signal source 56*d* into reference signal input terminals 210*d*, 211*d* and a reference signal output from reference signal source 57*d* to reference signal input terminal 212*d* as processing targets. Signal processing performed by fourth signal processing unit 200*d* is the same as the signal processing performed by first signal processing unit 200*a* and thus descriptions of the signal processing will be omitted here.

Cancel signal adder 29 adds up the total eight cancel signals output by two each from first signal processing unit 200*a*, second signal processing unit 200*b*, third signal processing unit 200*c*, and fourth signal processing unit 200*d*, and outputs the added cancel signal to cancel signal output terminal 22. Cancel signal adder 29 is implemented by a processor such as DSP, for example, but may be implemented by an adder circuit using a microcomputer or an operational amplifier.

In a conventional active noise reducing device without combined reference signal generation unit 24*a*, when the reference signal sources are four biaxial acceleration sensors and four microphones as illustrated in FIG. 8, a number of adaptive filter units are necessary corresponding to the number of the reference signal sources. That is, the total 12 adaptive filter units are necessary.

In contrast to this, in active noise reducing device 20, the reference signals output from reference signal sources 57*a* to 57*d* are combined with the reference signals output from reference signal sources 56*a* to 56*d*, and thus the total eight adaptive filter units are necessary. That is, the number of the necessary adaptive filter units can be decreased by four.

In the example illustrated in FIGS. 8 and 9, one cancel sound source 52 is provided. However, cancel sound source 52 may be disposed at the four seats on the door sides in vehicle 50, for example, in some cases. That is, four cancel sound sources 52 may be disposed in some cases. In this case, in a conventional active noise reducing device, the total 4×12=48 adaptive filter units are necessary. However, in the configuration of active noise reducing device 20, the number of the necessary adaptive filter units is 4×8=32.

In this way, in active noise reducing device 20, the number of the adaptive filter units is decreased. That is, in active noise reducing device 20, the amount of arithmetic operations can be reduced.

(Other Exemplary Embodiments)

The first and second exemplary embodiments have been described so far. However, the present invention is not limited to the foregoing exemplary embodiments (the first and second exemplary embodiments).

In the foregoing exemplary embodiments, the reference signal sources are acceleration sensor, biaxial acceleration sensor, and microphone as an example. However, the reference signal sources are not limited to these devices.

In addition, there is no particular limitation on the disposition of the plurality of reference signal sources. Each of the plurality of reference signal sources is disposed anywhere in the vehicle such as engine, axle, tire, wheel well, knuckle, arm, sub-frame, or body. In particular, when a microphone is used as a reference signal source, the reference signal source needs to be disposed at a position more separated from a listener than the error signal source and thus the reference signal source is desirably disposed outside the space in the vehicle interior (the space as a target of noise reduction). However, the installation position is not limited.

In the first exemplary embodiment, targets of noise reduction are noise in a band of 300 Hz and less and noise in a band of 500 Hz to 700 Hz inclusive. In the second exemplary embodiment, targets of noise reduction are structure borne noise and air borne noise. However, there are no particular limitations on the type and band of noise as targets of noise reduction. For example, drumming noise of 40 Hz to 50 Hz inclusive, muffled sounds of the engine of around 100 Hz, and pattern noise of tires may be targets of noise reduction.

In the foregoing exemplary embodiments, the plurality of filters included in the combined reference signal generation unit is a low-pass filter and a bandpass filter. Alternatively, the plurality of filters may be selected as appropriate from among low-pass filter, bandpass filter, and high-pass filter (HPF). For example, both the plurality of filters may be bandpass filters, or one of the plurality of filters may be a low-pass filter and the other a high-pass filter.

In addition, a first reference signal and a second reference signal to which a first filter is applied may be combined with each other, and the first reference signal and a third reference signal to which a second filter different in pass band from the first filter may be combined with each other.

The active noise reducing devices according to the foregoing exemplary embodiments may be installed in a mobile device other than vehicles. The mobile device may be an aircraft or a ship, for example. The present invention may be implemented as a mobile device other than vehicles.

The configurations of the active noise reducing device according to the foregoing exemplary embodiments are mere examples. For example, the active noise reducing device may include constituent elements such as D/A converter, filter, power amplifier, or A/D converter.

The processing performed by the active noise reducing devices according to the foregoing exemplary embodiments is mere example. For example, part of the digital signal processing described above in relation to the foregoing exemplary embodiments may be implemented by analog signal processing.

In addition, for example, the processing executed by a specific processing unit in the foregoing exemplary embodiments may be executed by another processing unit. The execution order of the plurality of processes may be changed, or the plurality of processes may be executed in parallel.

In the foregoing exemplary embodiments, each of the constituent elements may be formed by dedicated hardware or may be implemented by executing a software program suited to each of the constituent elements. Each of the constituent elements may be implemented by a program execution unit such as a CPU or a processor reading and executing a software program from a recording medium such as hard disk or semiconductor memory.

Each of the constituent elements may be a circuit (or an integrated circuit). These circuits may constitute one circuit as a whole or may be separate circuits. These circuits may be general-purpose circuits or dedicated circuits.

The comprehensive or specific modes of the present invention may be implemented by system, device, method, integrated circuit, computer program, or non-transient recording medium such as computer readable CD-ROM. Alternatively, the present invention may be implemented by an arbitrary combination of system, method, integrated circuit, computer program, and computer readable non-transient recording medium.

For example, the present invention may be implemented as an active noise reducing method to be executed by the active noise reducing device (computer or DSP) or as a program for causing a computer or a DSP to execute the active noise reducing method. In addition, the present invention may be implemented as a combined reference signal generation device (signal processing device) that has the functions of the combined reference signal generation unit according to the foregoing exemplary embodiments. The combined reference signal generation device is used together with a general-purpose active noise reducing device, for example. In addition, the present invention may be implemented as a mobile device or a noise reduction system including the active noise reducing device, the plurality of reference signal sources, the cancel sound source, and the error signal source according to the foregoing exemplary embodiments.

The execution order of the plurality of processes performed by the active noise reducing device described in relation to the foregoing exemplary embodiments is a mere example. The execution order of the plurality of processes may be changed, or the plurality of processes may be executed in parallel.

Besides, the present invention includes modes obtained by making various modifications perceivable for persons skilled in the art to the foregoing exemplary embodiments or modes implemented by combining arbitrarily the constituent elements and functions in the foregoing exemplary embodiments without deviating from the gist of the present invention.

INDUSTRIAL APPLICABILITY

The noise reduction device in the present invention is useful as a device for reducing noise in a vehicle interior, for example.

REFERENCE MARKS IN THE DRAWINGS

10, 20: active noise reducing device
110, 111, 210*a* to 212*a*, 210*b* to 212*b*, 210*c* to 212*c*, and 210*d* to 212*d*: reference signal input terminal
12, 22: cancel signal output terminal
13, 23: error signal input terminal
14, 24*a*: combined reference signal generation unit
140, 141, 240*a*, 242*a*: filter
149, 249*a*: adder
29: cancel signal adder
15, 250*a*, 251*a*: adaptive filter unit
16, 260*a*, 261*a*: simulated acoustic transmission characteristic filter unit
17, 270*a*, 271*a*: filter coefficient update unit
18, 28: storage unit
200*a*: first signal processing unit
200*b*: second signal processing unit
200*c*: third signal processing unit
200*d*: fourth signal processing unit
50: vehicle
510, 511, 56*a* to 56*d*, 57*a* to 57*d*: reference signal source
52: cancel sound source
53: error signal source
54: vehicle main body
55: space
N0: noise
N1: cancel sound

The invention claimed is:

1. An active noise reducing device that reduces noise in a predetermined space, the active noise reduction device comprising:

a plurality of reference signal input units that accepts inputs of a plurality of reference signals correlating with the noise;

a combined-reference-signal generation unit that generates a combined reference signal from the plurality of reference signals which is input;

an adaptive filter unit that applies an adaptive filter to the combined reference signal generated, to generate a cancel signal;

a cancel signal output unit that outputs the cancel signal generated;

an error signal input unit that accepts input of an error signal corresponding to a residual sound resulting from interference between the noise and a cancel sound source generating a cancel sound corresponding to the cancel signal;

a simulated acoustic transmission characteristic filter unit that generates a filtered combined reference signal by correcting the combined reference signal with a simulated transmission characteristic in which an acoustic transmission characteristic from the cancel signal output unit to the error signal input unit is simulated; and a filter coefficient update unit that updates a coefficient of the adaptive filter in succession based on the error signal and the filtered combined reference signal generated, wherein the combined-reference-signal generation unit includes a plurality of filters that is applied respectively to the plurality of input reference signals, and an adder that adds up the plurality of reference signals to which the plurality of filters is applied respectively, to generate the combined reference signal, and wherein the plurality of filters includes a filter with a passband of frequencies having mainly structure borne noise that is applied to a reference signal output by an acceleration sensor out of the plurality of reference signals, and a filter with a passband of frequencies having mainly air borne noise that is applied to a reference signal output by a microphone out of the plurality of reference signals.

2. The active noise reducing device according to claim 1, wherein at least one of the plurality of filters is a bandpass filter.

3. The active noise reducing device according to claim 2, wherein one of the plurality of filters is a low-pass filter.

4. The active noise reducing device according to claim 1, wherein the plurality of filters characteristically has respective passbands not overlapping with each other.

5. The active noise reducing device according to claim 1, wherein the error signal is input from an error signal source disposed in the predetermined space into the error signal input unit, and each of the plurality of reference signals is input from a reference signal source disposed outside the predetermined space.

6. The active noise reducing device according to claim 5, wherein the reference signal source is one of an acceleration sensor and a microphone.

7. A mobile device, comprising:

the active noise reducing device according to claim 1;

a reference signal source that outputs the plurality of reference signals, wherein the reference signal source includes the acceleration sensor and the microphone; and an error signal source that outputs the error signal into the error signal input unit.

8. The mobile device according to claim 7, wherein the mobile device is a vehicle the predetermined space is a space in a vehicle interior, and the noise is road noise.

9. An active noise reducing method for reducing noise in a predetermined space, the active noise reducing method comprising:

generating a combined reference signal from a plurality of reference signals correlating with the noise;

applying an adaptive filter to the combined reference signal generated, to generate a cancel signal;

generating a filtered combined reference signal by correcting the combined reference signal with a simulated transmission characteristic in which an acoustic transmission characteristic of a cancel signal output unit that outputs a cancel sound generated by a cancel sound source corresponding to the cancel signal to an error signal input unit that accepts input of an error signal corresponding to a residual sound resulting from interference between the cancel sound and the noise; and updating a coefficient of the adaptive filter in succession based on the error signal and the filtered combined reference signal generated, wherein the generating of the combined reference signal includes applying a plurality of filters respectively to the plurality of reference signals, and adding up the plurality of reference signals to which the plurality of filters is applied respectively to generate the combined reference signal, and wherein the applying the plurality of filters includes applying a filter with a passband of frequencies having mainly structure borne noise to a reference signal output by an acceleration sensor out of the plurality of reference signals, and applying a filter with a passband of frequencies having mainly air borne noise to a reference signal output by a microphone out of the plurality of reference signals.

* * * * *